United States Patent [19]

Frelk

[11] 4,401,359

[45] Aug. 30, 1983

[54] INTEGRATED WIRE TERMINATION SYSTEM TERMINAL WITH FASTENED RETAINER

[75] Inventor: Elmer S. Frelk, Sarasota, Fla.

[73] Assignee: Eaton Corporation, Cleveland, Ohio

[21] Appl. No.: 316,459

[22] Filed: Oct. 30, 1981

[51] Int. Cl.[3] ..... H01R 11/22

[52] U.S. Cl. ..... 339/253 R

[58] Field of Search ..... 339/74, 253

[56] References Cited

U.S. PATENT DOCUMENTS

| | | | |
|---|---|---|---|
| 2,235,275 | 3/1941 | Winning | 339/259 |
| 3,170,752 | 2/1965 | Van Horssen | 339/74 R |
| 3,237,149 | 2/1966 | West | 339/256 |
| 3,716,817 | 2/1973 | Wolfe, Jr. et al. | 339/74 R |
| 3,902,153 | 8/1975 | Narozny | 339/214 |
| 4,189,204 | 2/1980 | Brown et al. | 339/275 R |

*Primary Examiner*—Joseph H. McGlynn

*Attorney, Agent, or Firm*—C. H. Grace; W. A. Autio

[57] ABSTRACT

A connector socket terminal structure (6) of the integrated wire termination system type for accepting wires (12) with complemental mating pins (8) and is especially suitable for use in environmentally sealed aircraft switches. The retainer (10) is disposed in a hollow terminal (2) and serves to lock the wire termination pin (8) in place in the terminal and insure good electrical contact. The retainer (10) is pressure assembled within the terminal bore (2*d*, 2*e*) by forming it of slightly larger diameter than of the bore and squeezing it when it is pushed therein. To control the depth of insertion of the retainer (10) in the bore, the bore (2*d*, 2*e*) is provided with a shoulder and the retainer is provided with a plurality of sheared tabs (10*a*) spaced therearound that abut the shoulder to limit its depth of insertion. To fix the retainer (10) rigidly within the bore, a thin section (2*g*) is formed at the mouth of the bore which is bent or rolled over the bottom edge of the retainer to fix it rigidly between this bent over lip and the shoulder within the bore. This retainer (10) is provided with guiding and centering fingers (10*b*) and retention fingers (10*c*) so that when a collared wire termination pin (8) is inserted therein it is centered by the centering and guiding fingers and is clasped below the collar (8*c*) by the retention fingers (10*c*) so that it is locked therein for good electrical contact and great pull out strength.

5 Claims, 6 Drawing Figures

INTEGRATED WIRE TERMINATION SYSTEM TERMINAL WITH FASTENED RETAINER

BACKGROUND OF THE INVENTION

Integrated wire termination systems with reflow bonded retainers have been known heretofore. For example: Harry W. Brown U.S. Pat. No. 4,189,204, dated Feb. 19, 1980 and assigned to the assignee of this invention discloses a wire retainer that is plated with tin. This retainer is then inserted into the terminal and the bottom edge of a reduced portion of the terminal is curled or peened over inwardly to prevent the retainer from coming out. The terminal and retainer are then heated to melt and reflow the tin to create, when solidified, a bond between the retainer and terminal. This holds the retainer locked in place within the bore of the terminal and in a position such that the tabs of the retainer are free and clear of the bottom of the blind bore within the terminal. While this patented design has been useful, it has, nevertheless, been handicapped by the rather costly soldering operation and the inability to control the depth of insertion of the retainer within the terminal bore. Also, the soldering operation is difficult to control since it takes place within the terminal and has resulted in too high a scrap factor.

SUMMARY OF THE INVENTION

An object of the invention is to provide an improved integrated wire termination system.

A more specific object of the invention is to provide an improved wire retainer for an integrated wire termination system having improved means for locking the same at a controlled depth within the blind bore of a contact terminal.

Another specific object of the invention is to provide improved means for controlling the depth of insertion of a wire retainer within the bore of a contact terminal and locking the same in place.

Another specific object of the invention is to provide an improved wire retainer for a contact terminal that is simple in construction and economical to manufacture and assemble.

Other objects and advantages of the invention will hereinafter appear.

DESCRIPTION OF THE PREFERRED EMBODIMENT

Figure 1:
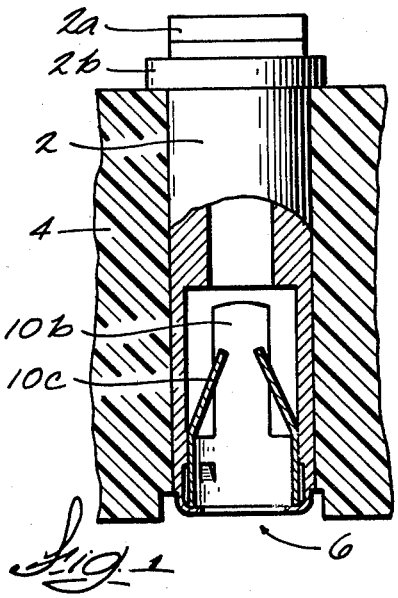
FIG. 1 is an enlarged partial elevational and partial cross-sectional view of an integrated wire termination system terminal with fastened retainer constructed in accordance with the invention.

Referring to FIG. 1 there is shown an assembled view of a contact terminal 2 molded into a plastic base 4 of a toggle switch or the like, for example, a toggle switch such as is shown in the aforementioned Harry W. Brown U.S. Pat. No. 4,189,204. As shown in that patent, a number of these contact terminals may be molded or otherwise secured into the base of a toggle switch to serve as the stationary contacts thereof which are engaged by a movable contact. This contact terminal 2 has a contact 2*a* at its upper end which will be engaged by a movable contact and a terminal at its lower end generally indicated by 6 to which an electric wire is attached to connect the contact terminal to an external circuit. This contact terminal 2 is preferably made of brass or the like and has a coin silver tip 2*a*, brazed to its upper end for making good electrical contact with the movable contact. A short flange 2*b* on this contact terminal 2 overlies the edge of the base and locates the contact tip 2*a* within the base.

Figure 3:
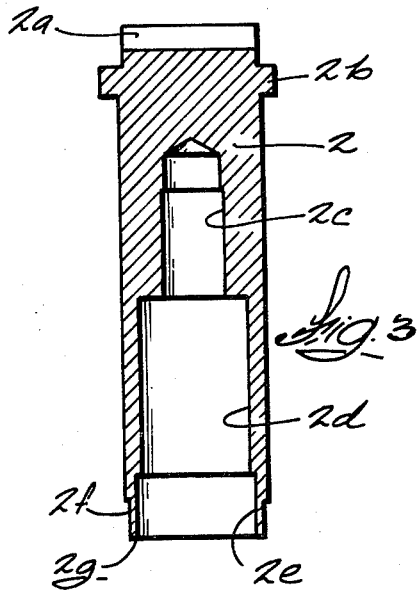
FIG. 3 is a cross-sectional view of the contact terminal of FIG. 1 prior to insertion and locking of the wire retainer therein.
Figure 2:
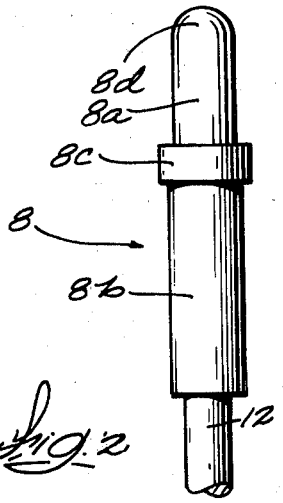
FIG. 2 is an elevational view of a wire pin adapted to be inserted into the retainer of FIG. 1.

As shown in FIG. 3, contact terminal 2 has a blind bore extending up from its lower end, this bore having several different diameters hereinafter described. The upper end of this bore has the smallest diameter 2*c* which is large enough to receive the tip or head 8*a* of a wire connector pin 8. Immediately therebelow is an intermediate diameter portion 2*d* which is large enough to receive wire retainer 10 and immediately therebelow at the lower end of contact terminal 2 is the largest diameter portion 2*e* of the bore which is slightly larger than portion 2*d* and large enough to receive the stops or sheared tabs 10*a* of the wire retainer.

As shown in FIG. 3, the extreme lower end portion of contact terminal 2 is provided with a reduced external diameter 2*f* to provide a thin section which may be rolled or bent over to lock the wire retainer within the bore as hereinafter more specifically described.

Figure 6:
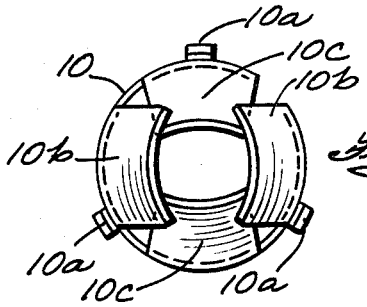
FIG. 6 is a top view of the wire retainer of FIG. 4.
Figure 4:
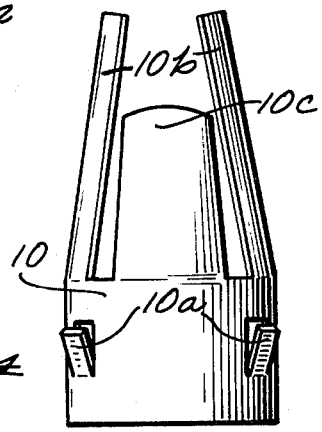
FIG. 4 is an enlarged elevational view of the wire retainer of FIG. 1 turned 90 degrees from the position in which it appears in FIG. 1.
Figure 5:
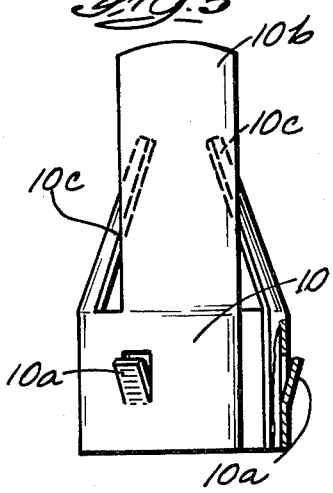
FIG. 5 is an elevational view of the wire retainer of FIG. 4 turned 90 degrees.

As shown in FIGS. 4, 5 and 6, wire retainer 10 is made from a sheet of beryllium copper or the like. This retainer sheet is provided with means for limiting the depth of insertion of wire retainer 10 into the contact terminal bore. This means comprises a plurality, such as 3, tabs 10*a* sheared from the sheet of beryllium copper and bent at a small angle outwardly so that the ends thereof catch on the shoulder between intermediate bore 2*d* and lower bore 2*e* of the contact terminal. As shown in FIG. 6, these sheared tabs are spaced equally such as by 120 degrees around the cylindrical portion of the wire retainer near its lower end and extend out substantially equal to the radial difference between portions 2*d* and 2*e* of the bore.

This wire retainer 10 is also provided with means for centering and guiding head 8*a* of wire pin 8 as it is inserted into the contact terminal. This means comprises a pair of leaves or fingers 10*b* that are bent toward one another and are diametrically opposite one another after the retainer sheet has been rolled into a circle as shown in FIGS. 4, 5 and 6.

This wire retainer is also provided with means for retaining and locking wire pin 8 in the contact terminal after it has been inserted therein. This means comprises a pair of shorter leaves or fingers 10*c*, that is, shorter than fingers 10*b*, that are bent toward one another and are diametrically opposite one another and interspersed angularly between fingers 10*b* when the retainer sheet has been rolled up into a circle as shown in FIGS. 4, 5 and 6.

Wire pin 8 has a head or tip 8*a*, a body portion or stem 8*b*, and a short annular flange or collar 8*c* therebetween. The lower end of stem 8*b* has a hollow or blind hole into which the bare conductor portion of wire 12 is soldered. The tip 8*d* of head portion 8*a* is rounded to guide its entry into the upper end portion 2*c* of the bore in contact terminal 2.

From the foregoing it will be apparent that wire retainer 10 is assembled into the contact terminal by inserting it, fingers first, into the bore 2*d* until the ends of tabs 10*a* abut against the shoulder between portions 2*d* and 2*e* of the bore. In this position it will be apparent that guiding and centering fingers 10*b* do not abut the end of portion 2*d* of the bore and will be free to flex outwardly when wire pin 8 is inserted therein. Wire retainer 10 is held in this bore with the ends of tabs 10*a* abutting the shoulder therein and thin end section 2*g* is bent or rolled over the bottom edge of the wire retainer to lock it in place. From this it will be apparent that the shoulder within the bore and the tabs on the wire retainer limit and control the depth of insertion of the wire retainer in the bore. These tabs and shoulder along with rolling over the thin lower portion of the contact terminal also serve to rigidly secure the wire retainer in a fixed position within the bore.

When a wire pin 8 is inserted into the retainer, tip 8*d* of the head thereof will enter between retention fingers 10*c* spreading them apart as the tip moves up. This tip 8*d* will then engage guiding and centering fingers 10*b* spreading them apart as it moves up into smaller diameter portion 2*c* of the bore, this portion of the bore being dimensioned so that head 8*a* of the wire pin can enter freely thereinto. As this wire pin is pushed further into the contact terminal bore collar 8*c* thereof will engage retention fingers 10*c* as well as guiding and centering fingers 10*b* spreading them apart until eventually collar 8*c* will move past the upper ends of retention fingers 10*c* and the latter will snap in underneath this collar. As a result, wire pin 8 will be securely retained in the contact terminal bore and in electrical connection with contact tip 2*a*.

To provide a good electrical connection from wire pin 8 to the contact terminal, wire retainer 10 is rolled into a circle larger than portion 2*d* of the bore in the contact terminal. Therefore, when retainer 10 is inserted into the bore, it is squeezed into a smaller diameter and will have an inherent outward bias to maintain it in pressure contact with the inside surface of the bore. Also, when wire pin 8 is inserted into the wire retainer, both retention fingers 10*c* and guiding and centering fingers 10*b* are spread apart and afford an inherent inward bias to maintain them in pressure contact with tip 8*a* and stem 8*b* of wire pin 8. Thus a good electrical connection extends all the way from wire 12 through wire pin 8, retainer 10 and contact terminal 2 to stationary contact 2*a*.

In order to release wire pin 8 from the retainer, a split, tubular release tool is placed around stem 8*b* of wire pin 8 and is pushed in to spread retention fingers 10*c* enough to clear collar 8*c*. Wire pin 8 and the release tool can then be simultaneously pulled out to separate the connector. It will be apparent that the thickness of such tubular release tool must be enough to spread retention fingers 10*c* far enough to clear flange 8*c* of wire pin 8.

From the foregoing, it will be apparent that the invention provides an integrated wire termination system with fastened retainer that is simple in construction and economical to manufacture. Moreover, the assembly of the wire retainer can be fully controlled without the requirements of close tolerances in the manufacture of the parts, i.e., positive control of the depth of insertion of the wire retainer into the bore is firmly established so that consecutive assemblies will be alike and there is little or no likelihood of scrap parts. Also, since wire retainer 10 enters portion 2*d* of the bore a substantial distance and a sufficient number of tabs 10*a* may be provided spaced around the retainer, the retainer will be centered in the bore once it is assembled and there is little or no likelihood of it being canted or slanted in any way off from the center line of the contact terminal. This is particularly important because the head 8*a* of wire pin 8 must enter freely into the smaller diameter portion 2*c* of the bore as the wire pin is inserted in place.

The invention also provides an economical structure since the wire retainer can be formed while it is flat to provide tabs 10*a*, guiding and centering fingers 10*b* and retention fingers 10*c* and then rolled into a circular form slightly larger than its receiving bore in the contact terminal. By providing controlled depth of insertion of the wire retainer by means of tabs 10*a* and the shoulder within the bore and then rolling over the lip of the contact terminal, there is provided an effective and easily assembled device having great retaining strength.

While the apparatus hereinbefore described is effectively adapted to fulfill the object stated, it is to be understood that the invention is not intended to be confined to the particular preferred embodiment of integrated wire termination system terminal with fastened retainer disclosed, inasmuch as it is susceptible of various modifications without departing from the scope of the appended claims.

I claim:

1. An integrated wire termination system comprising in combination:

an elongated contact-terminal having a contact at one end and a blind bore extending in from the other end, said bore having a stepped-diameter configuration including a small diameter bore at its inner end portion, an intermediate diameter bore at its middle portion, and a larger diameter bore at its outer end portion providing an annular shoulder between said middle and outer portions of said bore;

a split cylindrical retainer having a plurality of stops formed integrally thereon in angularly spaced relation therearound and projecting outwardly to abut said annular shoulder so as to limit the depth of insertion of said retainer into said intermediate diameter bore, a pair of retention fingers bent toward one another and a pair of longer guiding and centering fingers bent toward one another and interspersed between said retention fingers within said intermediate diameter bore;

said contact terminal also having a thin section at the mouth of said bore rolled over the outer edge of said retainer to lock it rigidly between said rolled over thin section and said shoulder;

and an elongated connector pin secured to a wire and having a tip portion for free entry into said small diameter bore, an annular flange for locking by said retention fingers when it is pushed past the ends thereof, and a stem to which said wire is connected.

2. The integrated wire termination system claimed in claim 1, wherein;

the projections of said stops are in a common plane to abut said annular shoulder and thereby control the depth of insertion of said retainer within said bore so that the ends of said guiding and centering fingers remain clear of the shoulder between said intermediate diameter bore and said small diameter bore.

3. The integrated wire termination system claimed in claim 1, wherein:

said stops are tabs sheared from said cylindrical retainer and bent slightly outwardly so that their ends abut said annular shoulder.

4. The integrated wire termination system claimed in claim 1, wherein:

said split cylindrical retainer is initially formed into a diameter larger than said bore so that it must be squeezed for insertion therein and thus provides an inherent radially outward bias for good electrical contact with the wall of said bore.

5. The integrated wire termination system claimed in claim 4, wherein:

said split cylindrical retainer closely hugs the wall of said intermediate diameter bore under the force of said outward bias to maintain said retainer centered within said bore.

* * * * *